United States Patent [19]

Schneiter et al.

[11] 4,353,488

[45] Oct. 12, 1982

[54] FLEXIBLE CONTAINER WITH DISPLACEABLE FITTING AND PROBE COUPLER APPARATUS

[75] Inventors: John W. Schneiter, Arlington Heights; Lawrence R. Hogan, Lake Villa, both of Ill.

[73] Assignee: Container Technologies, Inc., Barrington, Ill.

[21] Appl. No.: 285,937

[22] Filed: Jul. 23, 1981

Related U.S. Application Data

[63] Continuation of Ser. No. 142,154, Apr. 21, 1980, abandoned.

[51] Int. Cl.[3] ..... B65D 47/28

[52] U.S. Cl. ..... 222/501

[58] Field of Search ..... 222/105, 107, 501, 520, 222/523, 525, 509, 545, 83; 141/21

[56] References Cited

U.S. PATENT DOCUMENTS

| | | |
|---|---|---|
| 710,631 | 10/1902 | Tietz . |
| 864,740 | 8/1907 | Hildenbrand . |
| 2,149,659 | 3/1939 | Bettis . |
| 2,717,720 | 9/1955 | Nissen . |
| 2,814,418 | 11/1957 | Rieke . |
| 3,201,148 | 8/1965 | Shurtleff . |
| 3,391,951 | 7/1968 | Miller . |
| 3,586,068 | 6/1971 | Nicholson . |
| 3,595,445 | 7/1971 | Buford et al. . |
| 3,647,122 | 3/1972 | Nigro . |
| 3,930,286 | 1/1976 | McGowen . |
| 4,010,786 | 3/1977 | Aguettant et al. . |
| 4,022,258 | 5/1977 | Steidley . |
| 4,137,930 | 2/1979 | Scholle . |

*Primary Examiner*—Stanley H. Tollberg

*Attorney, Agent, or Firm*—McCaleb, Lucas & Brugman

[57] ABSTRACT

A connector apparatus for use with various types of disposable flexible foodstuff containers, such as polymeric bags containing soft drink syrups, of the type having a fitment attached to a wall of the container. The novel fitment includes a displaceable valve means having a seal plug member slidably received within a passageway and capable of being releasably retained at a pre-fill position and lockably retained at a post-fill position. A mating probe connector is permanently attached to the food product delivery hose system and includes a probe adapter capable of being detachably secured to the novel fitment and a pointed push probe for engaging the seal plug member. Product drain and positive evacuation structures are provided to assure substantially complete draining of product from the container during use. The probe is directly manually movable.

11 Claims, 8 Drawing Figures

FIG. 1
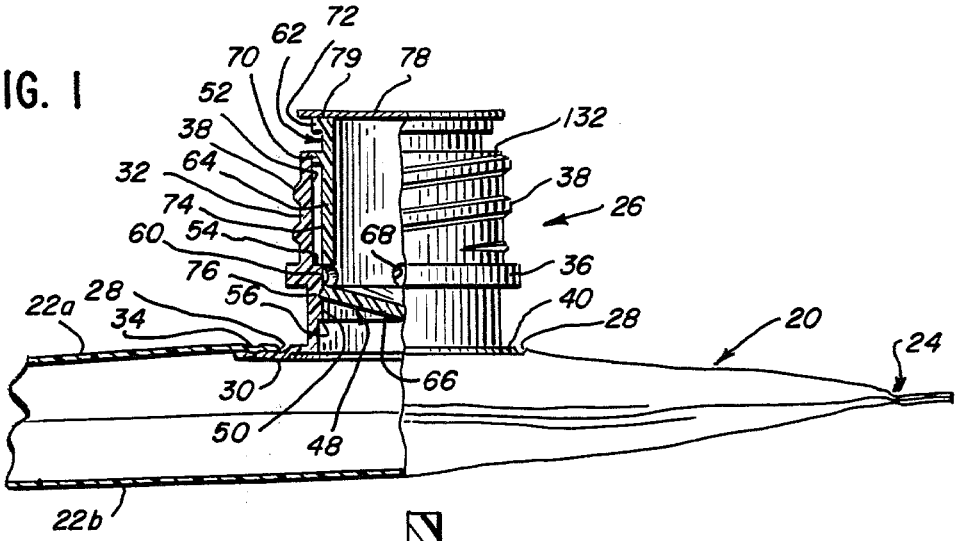
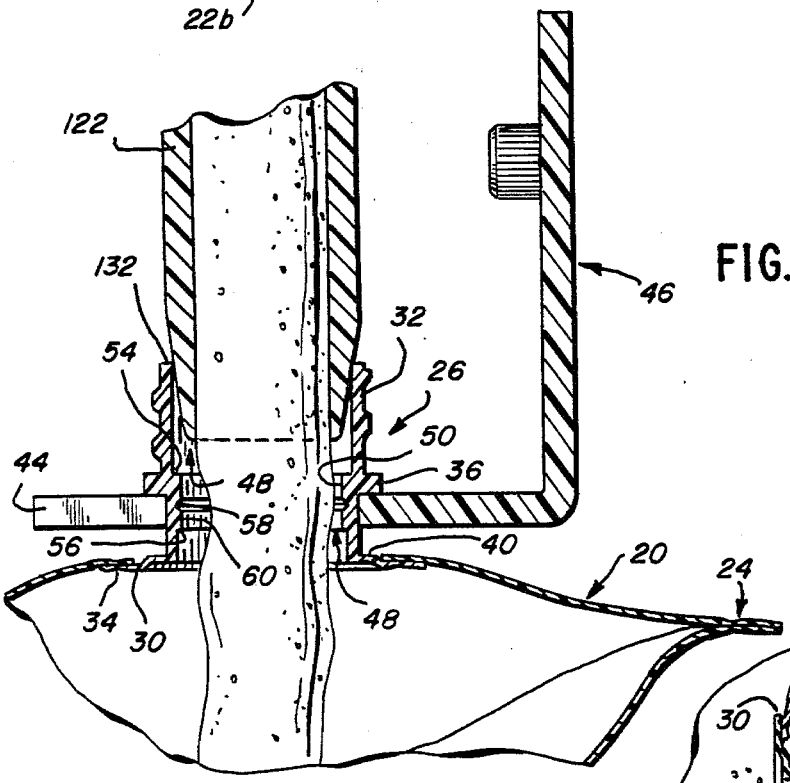
FIG. 2
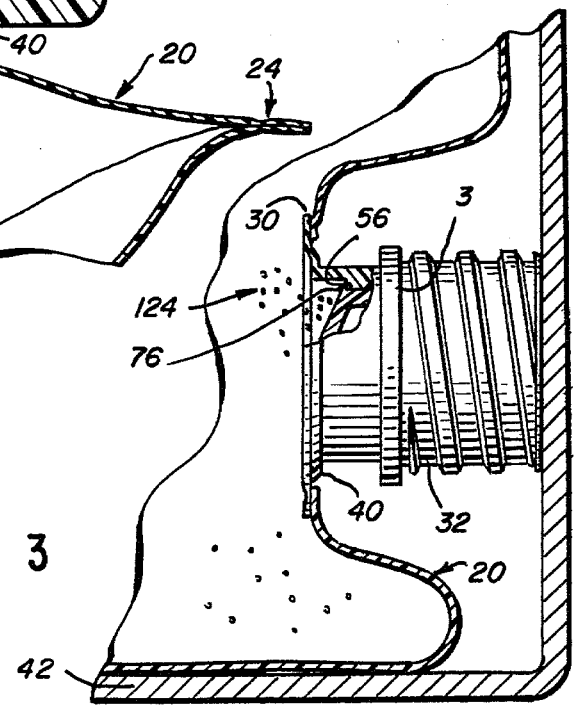
FIG. 3

FLEXIBLE CONTAINER WITH DISPLACEABLE FITTING AND PROBE COUPLER APPARATUS

DESCRIPTION OF THE INVENTION

This application is a continuation of Ser. No. 142,154 filed Apr. 21, 1980, abandoned.

FIELD OF THE INVENTION

This invention relates to container evacuation systems, and more particularly to a push probe type of connector apparatus for use with flexible polymeric bag-type containers.

DESCRIPTION OF THE PRIOR ART

There has been an ever growing need for an inexpensive delivery system by which successive disposable containers of liquid food product can be connected to a delivery hose system and evacuated. The need for such a system has been greatest in the soft drink syrup industry, such as by fast food operators, bars, restaurants, and the like. In the past, soft drink bottlers have provided syrup to their customers in pressurized containers, typically in the form of metallic and plastic canisters. Such pressurized containers were then connected to the customer's liquid dispensing system. The liquid contents were then forced out of the containers and into the delivery tube system by a pressurized gas, typically carbon dioxide.

Such prior art soft drink canisters, and the associated pressurized delivery systems, has numerous disadvantages. One problem is that because these prior art canisters were typically formed from stainless steel, there were continual deterioration problems due to the fact that the highly corrosive syrup concentrations were in direct contact with the canisters' stainless steel walls.

Another problem with such prior art pressurized canisters is that certain minimum pressure levels for the gas, such as carbon dioxide, is necessary to adequately force the soft drink product from the canister through the delivery tube system to the point of ultimate use. With certain diet soft drink syrups in which carbon dioxide is highly miscible, there oftentimes results in too much gas being entrained in the syrup due to the high gas pressure levels that are present. This results in poor taste characteristics for the finished soft drink product. Also, these pressurized canisters are oftentimes not entirely emptied in use, resulting in a continuous problem of residual product being left in the canisters and wasted. Further, use of such canisters is relatively expensive in that there are both high initial purchase costs involved as well as high transportation costs encountered in supplying canisters to the customer and returning them to the bottler. A more recent detrimental cost factor concerning such pressurized containers is the fact that the Federal Government has issued proposed guidelines under the Occupational Safety and Health Act which apparently labels them as "pressurized vessels", and as such, may require them to be annually inspected for safety reasons.

Thus, the ability to use disposable flexible polymeric containers with liquid food product delivery systems has become important. However, up until the present invention, there have not been many satisfactory methods by which flexible bag containers could be effectively and inexpensively connected to a liquid product delivery system. (See U.S. Pat. No. 4,137,930 for one known prior art methods.)

SUMMARY OF THE INVENTION

These and other prior art problems have been overcome by the present invention. It provides a novel coupler apparatus having a displaceable seal plug type of fitment and a push-probe connector apparatus for use with flexible containers, such as foodstuff bags made of polymeric materials, and with associated liquid product delivery systems. This novel coupler apparatus utilizes both reusable components and disposable components. The disposable components include the flexible bag within which the product is contained and transported, a pouring nozzle or so-called fitment joined to the bag, and a cylindrical-shaped displaceable plug member which is slidably received within a passageway formed in the fitment. The reusable components are in the form of a probe connector permanently affixed at the connection end of the product delivery tube for a soft drink dispensing system. This reusable connector includes a probe member, a probe adapter member within which the probe is slideably retained, and a fastener member operable to detachably connect the probe connector to the fitment.

In use, the probe connector unit (with the push probe in its retracted position) is threadedly connected to the fitment of a flexible polymeric bag filled with soft drink syrup, for example. Once properly connected, the push probe is forced into the fitment thereby engaging and displacing the fitment's seal plug member further into the fitment's passageway. This in turn exposes product drain means within both the seal plug and push probe thereby allowing food product to flow from the bag into the delivery tube and on into the dispensing system. The liquid product can be delivered either by gravity flow or under the positive pressure of an associated pump. Specific structure, including a novel flow pattern formed on the fitment's base flange, assures positive evacuation of product from the flexible bag. This is assured even when the bag has been substantially evacuated and its backwall has tended to flatten about the fitment's flange.

It is therefore a primary object of the present invention to provide a push probe type of coupler apparatus for use with flexible food bags that are to be connected to liquid delivery systems, and which includes both reusable components as well as inexpensive disposable components.

It is another object of the present invention to provide a fitment for a flexible foodstuff container which uses a displaceable seal plug and foil film seal to provide a tamper-proof product seal.

It is yet another object to provide a fitment for a flexible polymeric container which has a displaceable plug member for eliminating the majority of the food product from the fitment area thereby tending to reduce the overall oxygen transmission into the food product.

It is a further object of the present invention to provide a push probe type of coupler apparatus for soft drink syrup delivery systems having both leak-proof engagement to and dripless engagement from the fitment of a flexible container.

It is a still further object to provide a push probe type of coupler apparatus for a liquid dispensing system for a flexible foodstuff container whereby the probe is prohibited from inadvertently piercing a wall of the flexible container.

It is yet a further object to provide a seal plug member for the fitment of a flexible foodstuff container which can not be inadvertently displaced into the interior of the container.

The means by which the foregoing and other objects of the present invention are accomplished and the manner of their accomplishment will be readily understood from the following specification upon reference to the accompanying drawings, in which:

FIG. 1 is a partially fragmented elevation view of a flexible food bag fitted with the novel fitment and displaceable seal plug of the present invention;

FIG. 2 is an elevation view of the bag and fitment of FIG. 1, with certain parts removed, and as seen in the process of product filling;

FIG. 3 is an elevation view of the bag and fitment of FIG. 1, re-oriented in a shipping position;

DESCRIPTION OF THE PREFERRED EMBODIMENT

Figure 4:
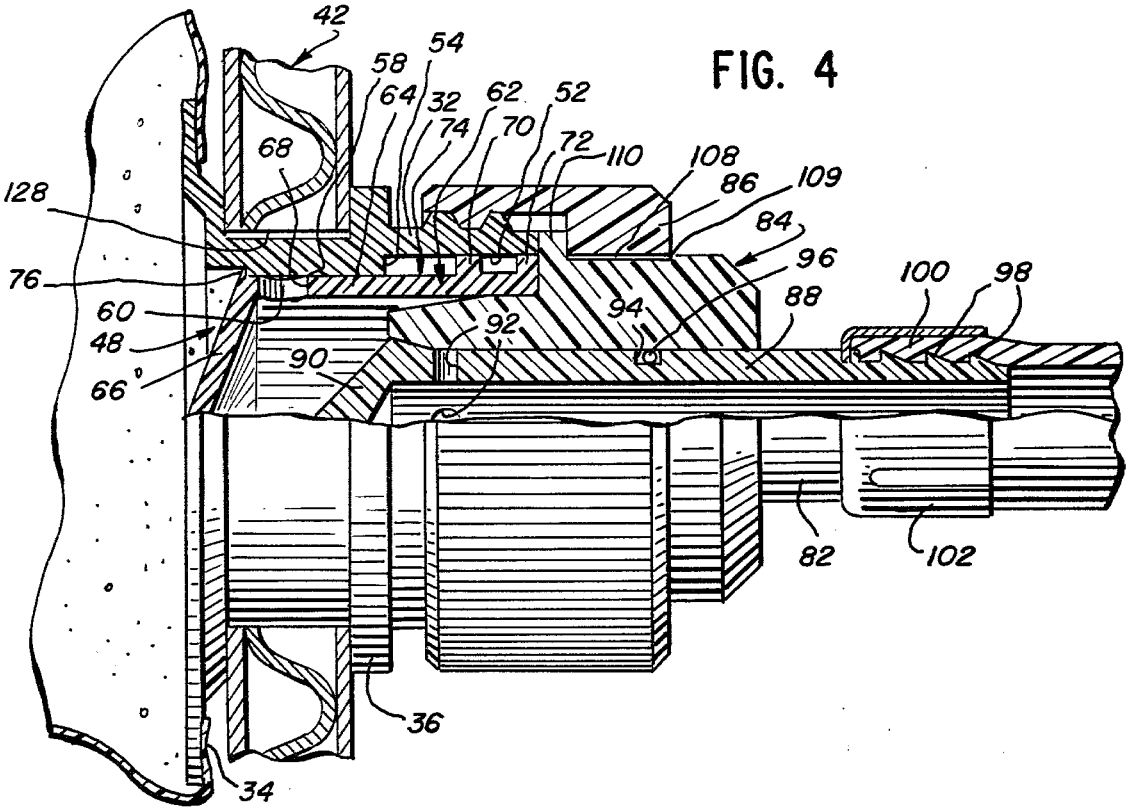
FIG. 4 is an enlarged elevation view of the bag and fitment of FIG. 3, and depicting additional coupler components in operating position.

Having reference to the drawings, wherein like reference numerals indicate corresponding elements, there is shown in FIG. 1 an illustration of a flexible polymeric food container, generally referred to by reference numeral 10. While not forming a part of the present invention, the bag 20 is of the type having walls 22*a*, 22*b* formed of multilayered polymeric film (not shown) which typically are thermally bonded at their edges, such as by a heat-seal 24. (See U.S. Pat. Nos. 3,090,526; 3,556,816; and 4,085,244 for a detailed description of such flexible foodstuff containers.)

A pouring nozzle or so-called closure fitment 26 is inserted through an opening 28 formed in bag wall 22*a*. The fitment includes a base flange portion 30 and a hollow cylindrical spout portion 32. The top side of base flange 30 is thermally bonded to the bottom surface of bag wall 22*a* at the periphery of the opening 28, such as by heat seal 34. On the outside of the cylindrical spout portion 32 are formed a shipping or filler support ring 36 and the threads 38. As is well known, when evacuating the contents of bag 20, the fill ring 36 can be used in conjunction with a base crown portion 40 (formed on base flange portion 30) so as to accommodate therebetween the wall 42 of a cardboard box container (see FIGS. 4, 5, and 6). Additionally, during filling of bag 20, the fill ring 36 can be used to support the fitment 26 between the yoke fingers 44 of a filling support stand 46 (see FIG. 2).

As seen in FIG. 2, a passageway 48 is formed within the hollow fitment 26, thereby providing communication between the interior of bag 20 and its exterior. An annular rib portion 50 is formed on the internal wall 52 of cylindrical spout portion 32 and projects inwardly into the passageway 48. The two radially-aligned end surfaces of annular rib 50 respectively provide a stop shoulder 54 and a lock step shoulder 56, the purpose of both of which will be explained later herein. Additionally, an annular groove 58 is formed on the inner wall 60 of the annular rib 50.

Figure 5:
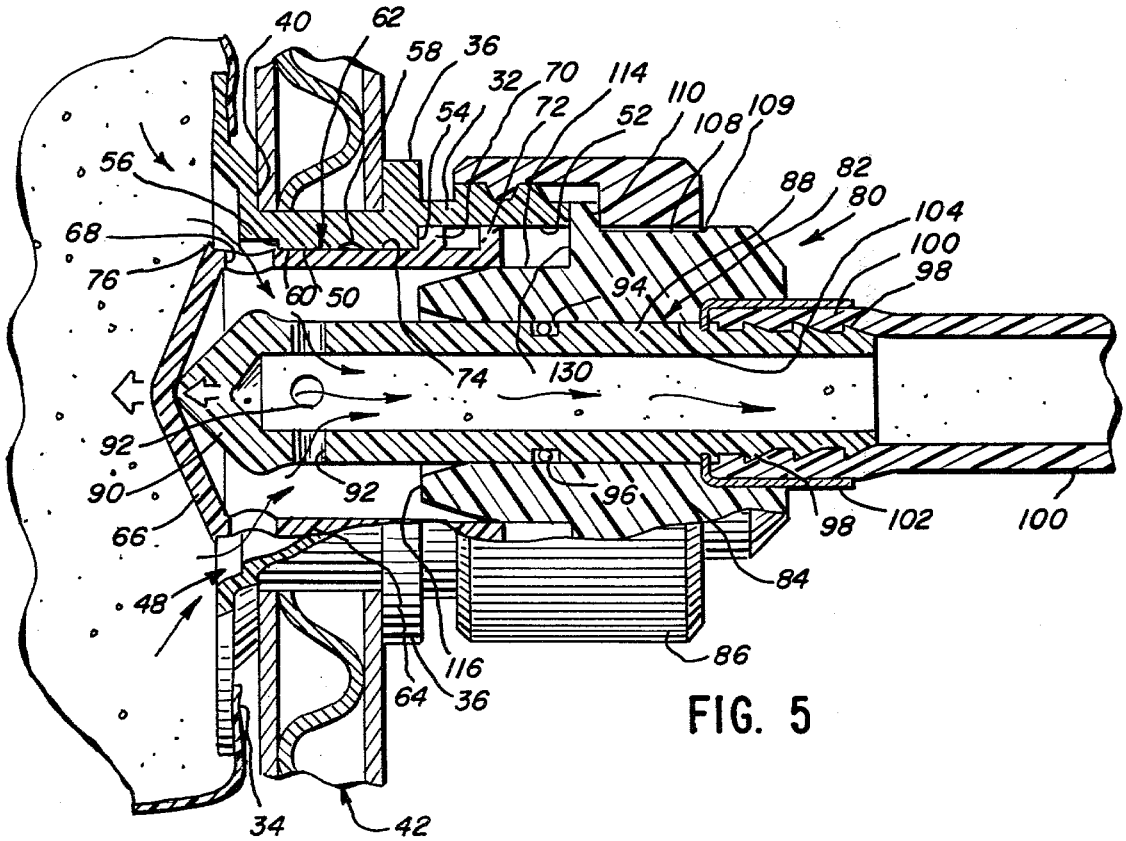
FIG. 5 is an enlarged elevation view similar to FIG. 4 and depicting the parts in another operating position.

A specially-configured seal plug member is generally referred to by reference numberal 62 (FIGS. 1, 4, and 5). The seal plug 62 comprises a tubular body portion 64 which terminates in a somewhat pointed end cap portion 66 at one end and is open at its other end. A first drain means in the form of a plurality of drain holes 68 is formed through the tubular body 64 of seal plug 62. An annular stop ring member 70 and a seal ring member 72 are formed on the outer cylindrical surfaces 74 of the seal plug 62 near the latter's open end. It is to be understood that the outer diameter of the tubular body portion 64 of seal plug 62 so corresponds to the inner diameter of inner wall 60 of annular rib 50 of spout 32 as to cause a sliding yet minor interference fit between the two members. Likewise, the respective outer diameters of the stop ring 70 and seal ring 72 closely correspond to the inner diameter of inner cylindrical surface 52 of spout 32. In this manner, it will be understood that the seal plug 62 (end cap 66 inserted first) can be slidably received within the passageway 48 of fitment 26 and act as a displaceable valve so as to block off the same.

An outwardly extending seal rib or wiper blade 76 is formed on plug 62 at the juncture of the peripheral edge of end cap 66 and the tubular body portion 64. The wiper blade 76 is formed with a slightly larger diameter than the outer diameter of the outer cylindrical surface 74 of plug 62. Thus, depending upon the inserted position of plug member 62 relative to the spout 32, the wiper blade 76 can be placed into groove 58 or engaged against the lock step shoulder 56.

A cap liner 78 formed of aluminum foil is placed across the open end of seal plug 62, see FIG. 1. One method for making and attaching a cap liner to a fitment is disclosed and described in U.S. Pat. No. 2,937,481. While the cap liner 78 forms no part of the present invention, its use is preferable so as to keep debris and contaminants from entering the interior of seal plug 62 prior to its use in evacuating the contents of the bag 20.

Figure 6:
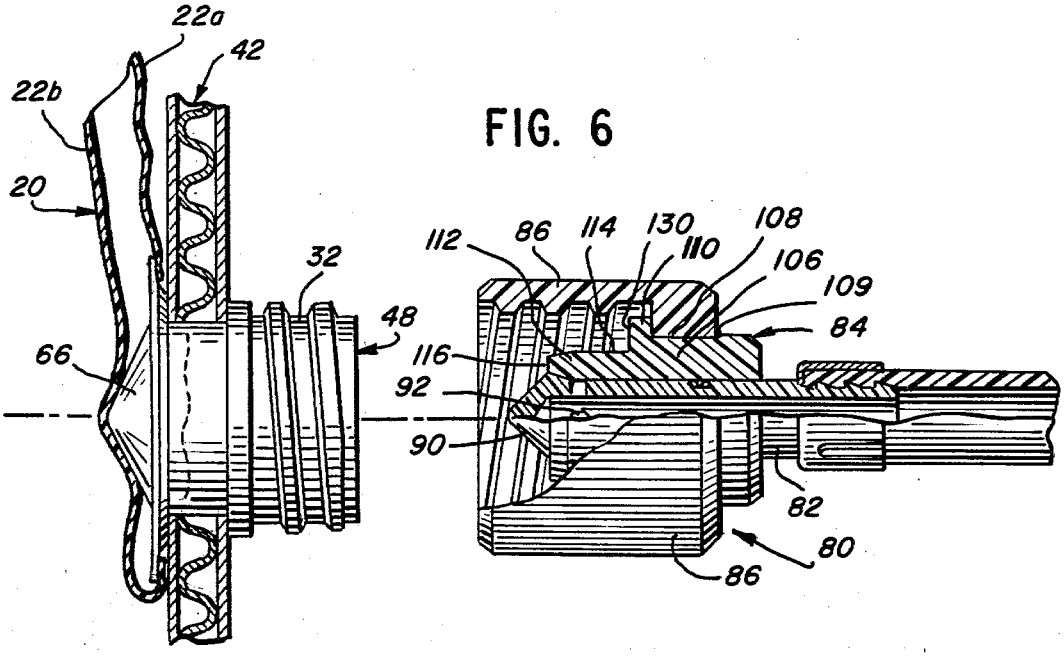
FIG. 6 is an elevation view similar to FIGS. 4 and 5, but depicting the components in yet another position.

Turning now to FIGS. 4, 5, and 6 (at the latter's right hand portion), there is shown a probe connector device, generally referred to by reference numeral 80. The probe connector 80 comprises a push probe member 82, a probe adapter 84, and a threaded fastener in the form of assembly nut 86. The push probe member 82 is comprised of an elongated tubular body portion 88 which terminates at one end in an enlarged probe point 90. Additionally, the hollow body portion 88 carries a second drain means, namely, a plurality of flow or drain holes 92 formed adjacent the probe point 90, and an annular channel 94 in which an "O" ring seal 96 is retained. The open end of push probe member 82 terminates in a series of annular grip rings 98 against which the end of a liquid product delivery tube 100 is compressed by ferrule 102.

The probe adapter 84 is of a hollow cylindrical shape and has an inner cylindrical surface 104. The adapter 84 comprises a major body segment 106 having an outer cylindrical surface 108, an annular chamfer 109, and an outwardly extending lip portion 110. Additionally, adapter 84 has a minor body segment 112 with an outer cylindrical surface 114 and terminates in a tapered end portion 116. It will be understood that the delivery tube 100 can be connected to any of various well-known liquid product or soft drink product delivery systems (not shown). Thus, the present invention can be used, for example, in a gravity-feed type system or in one operating under the positive pressure of an associated pump for delivering the liquid product to the point of end use.

Figure 7:
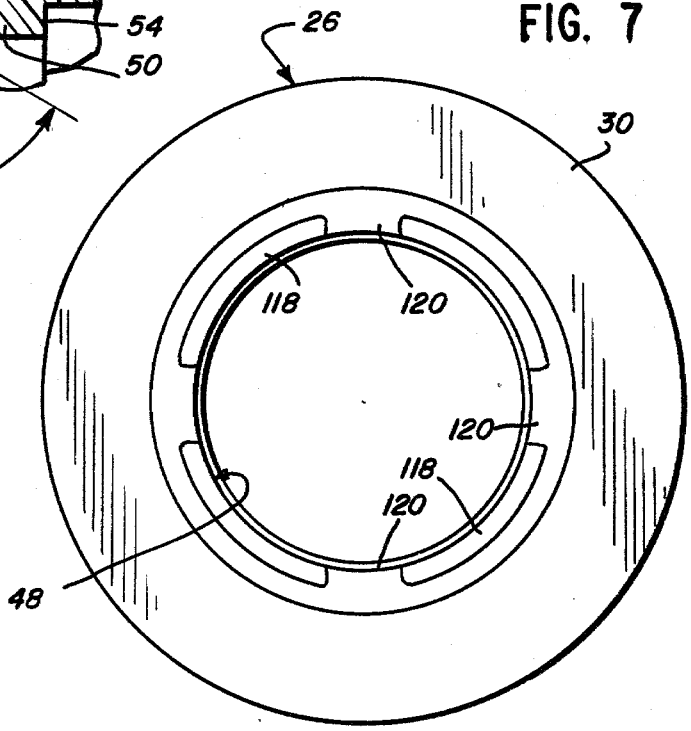
FIG. 7 is a bottom plan view of the novel fitment of FIG. 1.

There is shown in FIG. 7 a bottom plan view of the base flange 30 of fitment 26 of the preferred embodiment of the present invention. As will be discussed in greater detail later herein, positive evacuation means in the form of a plurality of segmented flow openings 118 separated by retainer tab portions 120 are formed adjacent the opening of passageway 48, the latter extending through the center of the fitment 26.

Figure 8:
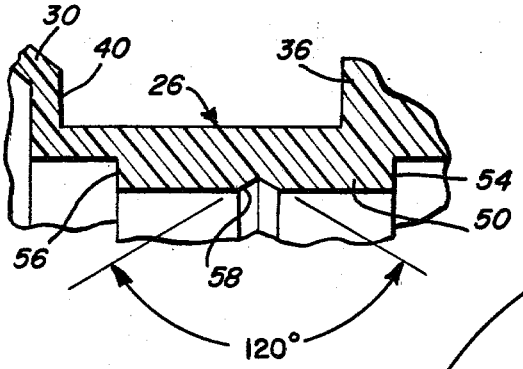
FIG. 8 is an enlarged fragmented sectional view, similar to FIG. 4, depicting a portion of the displaceable seal plug disclosed herein.

Turning now to operation of the preferred embodiment of the present invention, it will be seen in FIG. 1 that the seal plug 62 has been partially inserted into the passageway 48 of fitment 26. In this so-called "pre-fill" position of plug 62, the wiper blade 76 has engaged the detent groove 58 (FIG. 2). It will be noted that the walls of detent groove 58 are angularly disposed relative to blade 76, these groove walls preferably being formed at an angle of 120°, see FIG. 8. That coupled with the fact the outer diameter of wiper blade 76 and the diameter of the root of detent groove 58 are formed to be substantially the same, assures that plug 62 can only be releasably retained within the fitment 26 at this pre-fill position. Further, due to the engagements of wiper blade 76 with groove 58 and of stop ring 70 with inner surface 52 of spout 32, as well as the use of foil seal 78 on plug end surface 79, the plug 62 is able to block off passageway 48 thereby prohibiting entry of contaminants into the empty flexible bag 20 (FIG. 1). With the plug 62 placed in this detachable, pre-fill position relative to fitment 26, the empty bag 20 can be inexpensively transported in a substantially flat condition from the location of bag manufacture to the point of product filling, all without fear of contamination.

Turning to FIG. 2, it will be seen that the seal plug 62 has been temporarily removed from fitment 26 and the yoke fingers 44 of the fill support stand 46 have been inserted about fitment 26 so as to support the same by the fill ring 36. When so supported, the fitment 26 of and empty bag 20 can be engaged by a fill nozzle 122 of any well known product filling machine (not shown). Then the food product, such as liquid soft drink syrup 124, for example, can be introduced into bag 20. Once the bag 20 is filled, the seal plug 62 can be reinserted into passageway 48 of fitment 26 and placed in an intermediate, tamper-proof position as shown in FIG. 4. In this position, the wiper blade 76 of seal plug 62 has traveled on past the detent groove 58 until engaged against the lock step shoulder 56. It will be understood that due to the substantially radial alignment of the lock step shoulder 56, the wiper blade 76 (FIG. 4) is now lockably retained by shoulder 56. Once so positioned, the seal plug 62 can not be withdrawn from passageway 48 of fitment 26 without substantial visible damage to plug 62, thereby providing a tamper-proof closure for filled bag 20.

In this so-called "post-fill" or closed valve position, the seal plug 62 again acts to prohibit introduction of contaminants through fitment 26 into the interior of bag 20. This closed valve condition is due to the fact that the outer cylindrical surface 74 of plug 62 sealingly engages the inner cylindrical wall 60 of annular rib 50, and the stop ring 70 and seal ring 72 engage the spout surface 52. Additionally the foil seal 78 operates to prohibit entry of contaminates into seal plug 62. The filled container 20 is then ready to be transported to the point of end use, such as a fast food restaurant, in an appropriate cardboard container 42. (Reference is made to U.S. Pat. No. 3,108,732 for a disclosure of a typical bag-in-box arrangement.)

After delivery to the location of use, the filled bag 20 with box 42 can easily be set up for evacuation of the product 124 from bag 20. The foil seal 78 is removed and discarded. The fitment 26 is inserted through an opening 128 in container wall 42 until the same is retained about fitment 26 between the fitment's base crown 40 and ship ring 36. It is to be understood that at this juncture, the seal plug 62 still remains in its post-fill position and the wiper blade 76 remains engaged against shoulder 56. Also, the outer pointed end of plug cap 66 has not yet been displaced beyond base flange 30 of fitment 26 into the interior of bag 20.

At this point, push probe 82 of the probe connector 80 is in its retracted or so-called "back-seated" position (FIG. 6). This back-seating assures that no product left in delivery tube 100 will leak out, due to O-ring 96 and the closing off of drain holes 92 by adapter 84. The back-seated probe 82 and adapter 84 are then inserted into the plug member 62 which is seated within fitment 26. This insertion of adapter 84 into plug 62 is facilitated by tapered adapter end 116. Once probe 82 and adapter 84 are fully inserted, the radial shoulder 130 (of adapter body segment 106) engages both the outer plug end 79 and outer spout end 132. To assure that shoulder 130 properly seals against outer spout end 132, the assembly nut 86 is fastened against spout threads 38 until the adapter lip 110 is sealingly clamped between outer spout end 132 and nut 86.

Once the fitment 26 and probe connector 80 are so fastened together, they become an integral unit into which no contaminants can enter and no product will leak. Then the push probe 82 can be grasped by the ferrule 102 and manually moved (to the left of its position in FIG. 4) whereby the probe point 90 engages the backside of plug cap 66. Continued movement of probe 82 (to the left) causes the seal plug 62 to move to its final drain position as shown in FIG. 5. In this valve-open position, the seal plug 62 moves to the left until stop ring 70 engages spout stop shoulder 54. The engagement of these stop members prohibits plug 62 from being inadvertently displaced into and lost within the interior of bag 20.

Once seal plug 62 is displaced into this valve-open position (see FIGS. 5 and 6), the passageway 48 is opened. This is because there is communication between the interior of the bag 20, the first drain means (drain holes 68 on plug 62), the now uncovered second drain means (drain holes 92 on push probe 82), the hollow interior of push probe member 82, and ultimately the point of end use of food product 124 via product delivery tube 100.

As seen in the left hand portion of FIG. 6, the liquid contents 124 of food bag 20 can be evacuated, whether by positive pump, gravity, or other means, until the bag is substantially collapsed against the bottom of fitment 26 and the plug end cap 66. In the present invention, substantially complete evacuation of bag 20 is assured by positive evacuation means. In the preferred embodiment, this is provided by flow openings 118 and retainer tabs 120 (FIG. 7) which cooperate to provide positive evacuation of the contents of bag 20 into and through passageway 48 of fitment 26. In essence, even if the backwall **22*b* of a partially-evacuated bag 20 would happen to prematurely collapse against fitment base flange 30, the tabs 120 would hold the wall 22*b* away from flow openings 118 such that product 124 would continue to drain from the bag 20**.

Once bag 20 has been emptied, the push probe 82 can again be back-seated within adapter 84 so as to close off drain holes 92. Then nut 86 can be unthreaded and the reusable probe connector 80 can be disconnected from the emptied bag 20 which, along with fitment 26 and seal plug 62, is then disposed of. It will be noted that when connector 80 is disconnected, the point 90 of the back-seated push probe 82 does not extend out past the nut 86 (FIG. 6) as nut 86 is positioned and loosely retained relative to probe adapter 84 by the chamfer 109. This feature tends to eliminate any unwanted handling of the push probe 82.

From the foregoing, it is believed that those skilled in the art will readily appreciate the unique features and advantages of the present invention over previous types of fitments and couplers for flexible foodstuff bags. Further, it is to be understood that while the present invention has been described and illustrated with two particular preferred embodiments, as set forth in the accompanying drawings and as above described, the same nevertheless is susceptible to change, variation and substitution of equivalents without departing from the spirit and scope of this invention which should not be restricted by the foregoing description and drawings except as may appear in the following appended claims.

I claim:

1. In combination a fitment for a flexible food container, a displaceable seal plug, and a probe connector therefor, said fitment comprising a base flange portion capable of being joined to a wall of the flexible container and a hollow cylindrical spout portion extending therefrom, said spout portion having a passageway communicating with the container's interior, said spout portion further including detent means and lock means formed on the interior thereof; said displaceable seal plug comprising a tubular body portion characterized as having first drain means, said tubular body portion having blade means formed on the outer periphery thereof and terminating in an end cap portion, said seal plug capable of being slidably received within said passageway of said spout portion and characterized as being detachably retained within said passageway when said blade means engages said detent means and further characterized as being lockably retained within said passageway when said blade means engages said lock means; said probe connector comprising probe adapter means, push probe means slidably supported within said probe adapter means, and means for detachably securing said probe adapter means and supported push probe means to said fitment, said push probe means having second drain means, said push probe means characterized when secured to said fitment as operable upon the sliding displacement thereof to engage said end cap portion of said seal plug and to slidably displace said seal plug farther into said fitment thereby effecting communication between the interior of the flexible container, said first drain means, and said second drain means.

2. The invention of claim 1, and including stop means operable to prohibit excessive displacement of said seal plug within said fitment.

3. The invention of claim 1, and wherein said means detachably securing said probe adapter means and push probe means to said fitment comprises threaded fastener means.

4. The invention of claim 1, wherein said detent means comprises an annular groove formed on the interior of said hollow spout portion.

5. The invention of claim 1, wherein said lock means comprises an annular step shoulder formed on the interior of said hollow spout portion adjacent said base flange portion.

6. The invention of claim 1, wherein said fitment includes positive evacuation means formed on said base flange portion to assure substantially complete evacuation of said flexible container.

7. The combination of a closure fitment, a seal plug, and a probe connector for use with a flexible container, said closure fitment comprising a base flange portion and a hollow spout portion, said base flange and spout portions having a passageway formed therethrough; said seal plug comprising a tubular section having first drain means, said seal plug characterized as being slidably receivable within said passageway; a first means formed on said spout portion and operable to detachably retain said seal plug within said passageway at a first position; a second means formed on said spout portion and operable to lockably retain said seal plug within said passageway at a second position; said probe connector comprising elongated probe means having second drain means, probe adapter means slidably supporting said elongated probe means, and means for detachably connecting said probe adapter means to said cylindrical spout portion; whereby displacement of said elongated probe means, once said probe adapter means has been connected to said spout portion and said seal plug has been retained within said passageway at said second position, effects displacement of said seal plug to a drain position whereat said first and second drain means are in communication so as to open said passageway.

8. The invention of claim 7, and wherein said tubular section of said seal plug terminates in an end cap portion for engagement by said elongated probe means.

9. The invention of claim 7, and wherein said first means formed on said spout portion comprises a detent groove formed on the interior of said spout portion.

10. The invention of claim 7, and wherein said second means formed on said spout portion comprises a lock step shoulder formed on the interior of said spout portion.

11. A coupler apparatus for use in evacuating the contents of a flexible container, comprising in combination:

a fitment for attachment to a wall of a flexible container and comprising a base flange portion and a hollow spout portion, said spout portion having a first annular means and a second annular means formed on the interior thereof, said fitment characterized as having a passageway formed through said base flange and spout portions;

a seal plug member comprising an elongated hollow body portion terminating in an end cap portion, an annular seal rib formed on the outer periphery of said tubular body portion, and drain means carried by said tubular body portion, said seal plug member slidably receivable within said spout portion when inserted therein, said seal plug member characterized as being releasably retained at a first position within said passageway when said seal rib engages said first annular means, and further characterized as being lockably retained at a second position within said passageway when said seal rib engages said second annular means, said seal plug member operable to close off said passageway when at said first and second positions;

a probe connector comprising a hollow probe adapter member, an elongated probe member slidably supported within said probe adapter, and means for connecting said probe adapter member and supported probe member to said spout portion, said probe member having flow means;

whereby displacement of said probe member into said spout portion, once said seal plug is slidably received within said passageway, causes said seal plug to be displaced to a drain position whereat said drain means and said flow means are operable to effect communication through said passageway.

* * * * *

UNITED STATES PATENT AND TRADEMARK OFFICE

CERTIFICATE OF CORRECTION

PATENT NO. : 4,353,488

DATED : October 12, 1982

INVENTOR(S) : Schneiter, John W. and Hogan, Lawrence R.

It is certified that error appears in the above—identified patent and that said Letters Patent is hereby corrected as shown below:

Column 1, line 32, "has" should be -- had --; and

Column 4, line 12, "surfaces" should be -- surface --.

Signed and Sealed this

*Fourth* Day of *January 1983*

[SEAL]

*Attest:*

GERALD J. MOSSINGHOFF

*Attesting Officer* *Commissioner of Patents and Trademarks*